US009507310B2

(12) United States Patent
Nakajima

(10) Patent No.: US 9,507,310 B2
(45) Date of Patent: Nov. 29, 2016

(54) IMAGE FORMING APPARATUS HAVING CIRCUIT BOARD WITH SILK-PRINTED MARK FOR HOLDING CLAW

(71) Applicant: CANON KABUSHIKI KAISHA, Tokyo (JP)

(72) Inventor: Hirohisa Nakajima, Tsukubamirai (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/972,262

(22) Filed: Dec. 17, 2015

(65) Prior Publication Data

US 2016/0202655 A1 Jul. 14, 2016

(30) Foreign Application Priority Data

Jan. 13, 2015 (JP) ..... 2015-003955

(51) Int. Cl.
*G03G 15/00* (2006.01)

(52) U.S. Cl.
CPC ..... *G03G 15/80* (2013.01)

(58) Field of Classification Search
CPC ..... G03G 15/80
USPC ..... 399/90
See application file for complete search history.

(56) References Cited

U.S. PATENT DOCUMENTS 8,750,745 B2 * 6/2014 Fujiwara ..... G03G 15/80 399/90
2002/0070657 A1 * 6/2002 Park ..... H01J 29/76 313/440
2006/0008288 A1 * 1/2006 Kuma ..... G03G 15/80 399/90
2011/0286759 A1 * 11/2011 Ichihashi ..... G03G 15/167 399/90
2012/0308258 A1 * 12/2012 Ming Wang ..... G03G 15/80 399/107
2015/0205246 A1 * 7/2015 Kato ..... G03G 15/80 399/88

FOREIGN PATENT DOCUMENTS

JP 2002111147 A * 4/2002

OTHER PUBLICATIONS

Yoshida et al., Printed Circuit Board, Apr. 12, 2002, JP2002111147, Machine English Translation by JPO of Claims, Detailed Description, and Description of Drawings.*

* cited by examiner

*Primary Examiner* — Susan Lee
(74) *Attorney, Agent, or Firm* — Fitzpatrick, Cella, Harper & Scinto

(57) ABSTRACT

An image forming apparatus configured to form an image on a recording medium, including: a process unit, which a high voltage is applied to, configured to perform an image forming process; a circuit board configured to generate the high voltage; a holding claw configured to hold the circuit board; a power feed member configured to apply the high voltage to the process unit, the power feed member having an elastic member electrically connected to an output portion of the circuit board from which the high voltage is output in a state in which the circuit board is held by the holding claw; and a silk-printed mark put on the circuit board, the silk-printed mark indicating a portion of the circuit board to be pressed by an operator in order to cause the circuit board to be held by the holding claw.

18 Claims, 6 Drawing Sheets

IMAGE FORMING APPARATUS HAVING CIRCUIT BOARD WITH SILK-PRINTED MARK FOR HOLDING CLAW

BACKGROUND OF THE INVENTION

Field of the Invention

The present invention relates to an image forming apparatus configured to form an image on a recording medium.

Description of the Related Art

An electrophotographic image forming apparatus is configured to form an image on a recording medium using an electrophotographic image forming process. As the electrophotographic image forming apparatus, for example, there are known to be an electrophotographic copying machine (such as digital copying machine), an electrophotographic printer (such as color laser beam printer and color LED printer), a multifunction peripheral (MFP), a facsimile, and a word processor. The electrophotographic image forming apparatus (hereinafter referred to as "image forming apparatus") not only encompasses an image forming apparatus configured to form a monochrome image but also encompasses a color image forming apparatus.

The image forming apparatus includes a plurality of process units such as a photosensitive member, a charging device, a light scanning device (exposure device), a developing device, a transferring device, and a fixing device. The charging device uniformly charges a surface of the photosensitive member (image bearing member). The light scanning device emits a laser beam (hereinafter referred to as "light beam") modulated in accordance with image information onto the uniformly charged surface of the photosensitive member to form an electrostatic latent image on the surface of the photosensitive member. The developing device develops the electrostatic latent image into a developer image (toner image) using a developer (toner). The transferring device transfers the toner image, which is formed on the surface of the photosensitive member, onto the recording medium. The fixing device fixes the toner image onto the recording medium by heating and pressurizing the recording medium on which the toner image has been transferred. In this manner, the image forming apparatus forms an image on the recording medium.

The image forming apparatus includes a high-voltage circuit board configured to apply a high voltage to each of the photosensitive member, the charging device, the developing device, the transferring device, and the fixing device. The photosensitive member, the charging device, the developing device, and the transferring device are electrically connected to the high-voltage circuit board through respective power feed members.

U.S. Pat. No. 8,750,745 discloses an image forming apparatus including power feed members which are electrically connected to respective high-voltage contact portions of a high-voltage circuit board with springs and configured to hold the high-voltage circuit board. By pressing of the vicinities of holding portions of the high-voltage circuit board when mounting the high-voltage circuit board on a main body of the image forming apparatus, the high-voltage circuit board is held on the main body of the image forming apparatus and the high-voltage circuit board is electrically connected to the main body of the image forming apparatus. However, a problem arises in that, when an operator presses the circuit board at incorrect positions, the circuit board is not held suitably to cause connection failure.

SUMMARY OF THE INVENTION

In view of the above, the present invention provides an image forming apparatus constructed so that a circuit board can be mounted with good workability.

According to one embodiment of the present invention, there is provided an image forming apparatus configured to form an image on a recording medium, the image forming apparatus comprising:

a process unit to which a high voltage is applied, and the process unit being configured to perform an image forming process;

a circuit board configured to generate the high voltage to be applied to the process unit;

a holding claw configured to hold the circuit board;

a power feed member configured to apply the high voltage to the process unit, the power feed member having an elastic member electrically connected to an output portion of the circuit board from which the high voltage is output in a state in which the circuit board is held by the holding claw; and a silk-printed mark put on the circuit board, the silk-printed mark indicating a portion of the circuit board to be pressed by an operator in order to cause the circuit board to be held by the holding claw.

According to another embodiment of the present invention, there is provided an image forming apparatus configured to form an image on a recording medium, the image forming apparatus comprising:

a process unit to which a high voltage is applied, and the process unit being configured to perform an image forming process;

a circuit board configured to generate the high voltage to be applied to the process unit;

a holding claw configured to hold the circuit board;

a power feed member configured to apply the high voltage to the process unit, the power feed member having an elastic member electrically connected to an output portion of the circuit board from which the high voltage is output in a state in which the circuit board is held by the holding claw; and a silk-printed mark put on the circuit board, the silk-printed mark being in sight when the circuit board is not correctly held by the holding claw, and being out of sight when the circuit board is correctly held by the holding claw.

Further features of the present invention will become apparent from the following description of exemplary embodiments with reference to the attached drawings.

DESCRIPTION OF THE EMBODIMENTS

Embodiments of the present invention will be described below with reference to the accompanying drawings.

[First Embodiment]

(Image Forming Apparatus)

Figure 1:
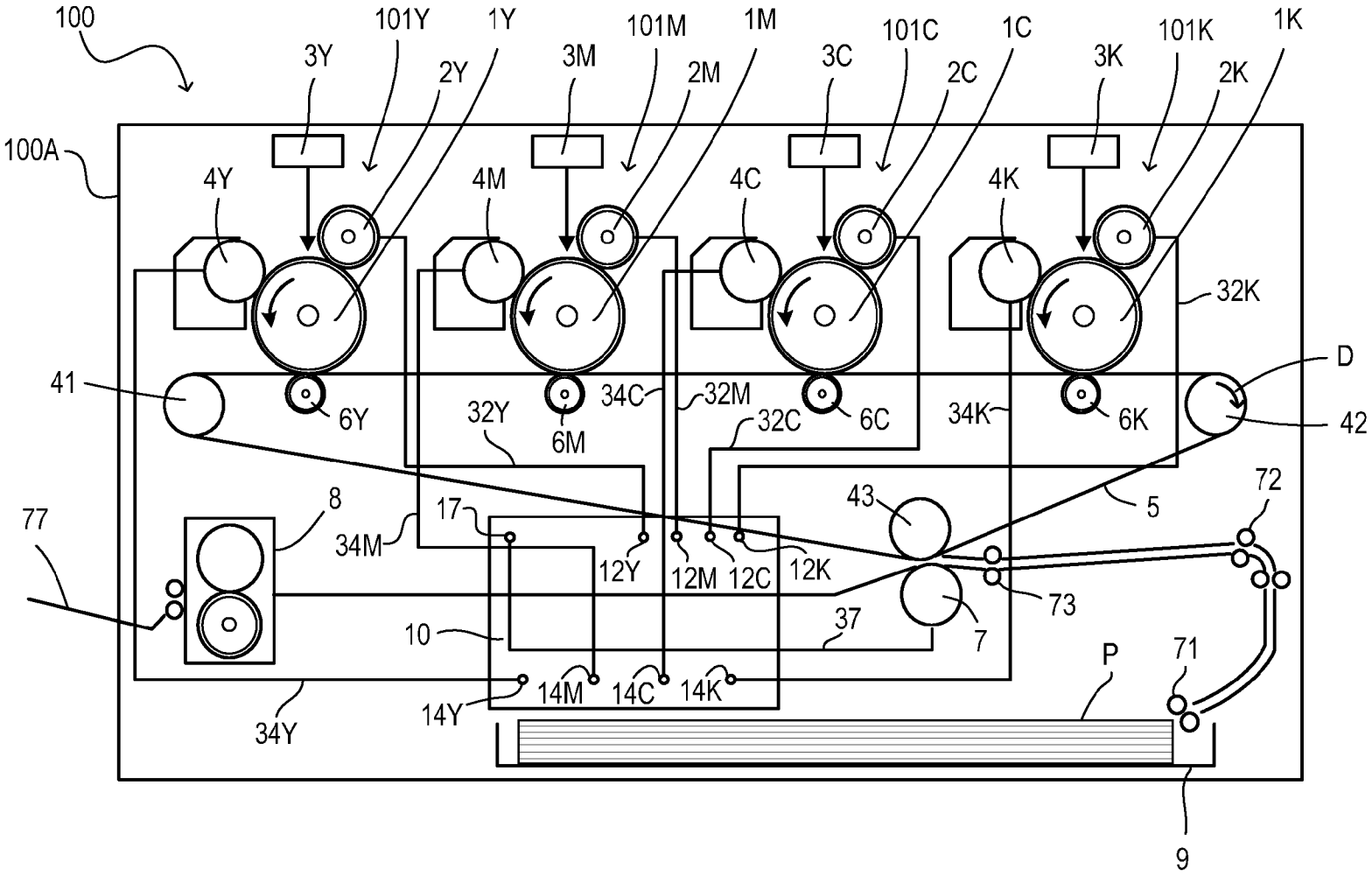
FIG. 1 is an explanatory view of an image forming apparatus.

An image forming apparatus according to a first embodiment of the present invention is as described below. FIG. 1 is an explanatory view of an image forming apparatus 100. The image forming apparatus 100 is configured to form an image on a recording medium P using an electrophotographic image forming process.

A main body 100A of the image forming apparatus 100 includes image forming portions 101 (101Y, 101M, 101C, and 101K). The image forming portion 101Y is configured to form a yellow image using yellow toner. The image forming portion 101M is configured to form a magenta image using magenta toner. The image forming portion 101C is configured to form a cyan image using cyan toner. The image forming portion 101K is configured to form a black image using black toner. The four image forming portions 101 have the same structure except for the colors of the developer (toner), and hence, in the following description, the suffixes Y, M, C, and K are omitted from reference symbols unless otherwise necessary.

The image forming portions 101 include photosensitive drums (image bearing members) 1 (1Y, 1M, 1C, and 1K) serving as photosensitive members, respectively. Around the photosensitive drums 1, there are arranged charging rollers (charging devices) 2 (2Y, 2M, 2C, and 2K), light scanning devices 3 (3Y, 3M, 3C, and 3K), developing devices 4 (4Y, 4M, 4C, and 4K), and primary transfer rollers (primary transfer devices) 6 (6Y, 6M, 6C, and 6K), respectively. An endless intermediate transfer belt (intermediate transfer member) 5 is arranged below the photosensitive drums 1.

The intermediate transfer belt 5 is stretched around a drive roller 41 and two driven rollers 42 and 43. The intermediate transfer belt 5 rotates in a direction indicated by the arrow D of FIG. 1 at the time of image formation. The primary transfer rollers 6 are arranged so as to be opposed to the photosensitive drums 1 across the intermediate transfer belt 5, respectively. The primary transfer roller 6 transfers a toner image, which is formed on the photosensitive drum 1, onto the intermediate transfer belt 5. A secondary transfer roller (secondary transfer device) 7 is arranged so as to be opposed to the driven roller 43 across the intermediate transfer belt 5. The image forming apparatus 100 includes a sheet feeding cassette 9 arranged on a lower part thereof, for receiving the recording medium P. The recording medium P is fed from the sheet feeding cassette 9 by pick-up rollers 71. The recording medium P is conveyed to the secondary transfer roller 7 by conveyance rollers 72 and registration rollers 73. A fixing device 8 is arranged on a downstream side with respect to the secondary transfer roller 7 in a conveyance direction of the recording medium P. A delivery tray 77 on which recording media P having images formed thereon are stacked is provided on a downstream side with respect to the fixing device 8 in the conveyance direction of the recording medium P.

(Image Forming Process)

Next, an image forming process of the image forming apparatus 100 will be described. The image forming processes of the four image forming portions 101 are the same, and hence the image forming process of the yellow image forming portion 101Y will be described below. The description of the image forming processes of the magenta image forming portion 101M, the cyan image forming portion 101C, and the black image forming portion 101K is omitted.

The charging roller 2Y uniformly charges a surface of the photosensitive drum 1Y. The light scanning device 3Y emits a light beam modulated in accordance with image information of a yellow component onto the uniformly charged surface of the photosensitive drum 1Y to form an electrostatic latent image on the photosensitive drum 1Y. The developing device 4Y develops the electrostatic latent image using the yellow toner (developer) into a yellow toner image. The primary transfer roller 6Y primarily transfers the yellow toner image, which is formed on the photosensitive drum 1Y, onto the intermediate transfer belt 5.

In the same way, a magenta toner image formed by the magenta image forming portion 101M is accurately transferred onto the yellow toner image on the intermediate transfer belt 5 in a superimposed manner. Then, a cyan toner image and a black toner image are sequentially transferred onto the magenta toner image on the intermediate transfer belt 5 in a superimposed manner. As a result, the four-color toner images are superimposed on the intermediate transfer belt 5.

The recording medium P conveyed from the sheet feeding cassette 9 is conveyed to the secondary transfer roller 7 by the registration rollers 73 in synchronization with the toner images on the intermediate transfer belt 5. The four color toner images superimposed on the intermediate transfer belt 5 are secondarily transferred onto the recording medium P by the secondary transfer roller 7 in a collective manner. The recording medium P having the toner images transferred thereon is conveyed to the fixing device 8. The fixing device 8 fixes the toner images onto the recording medium P by heating and pressurizing the recording medium P. The recording medium P having the image formed thereon is discharged onto the delivery tray 77.

The image forming apparatus 100 includes a high-voltage circuit board (hereinafter referred to as "circuit board") 10, and power feed members 32 (32Y, 32M, 32C, and 32K), 34 (34Y, 34M, 34C, and 34K), and 37. The circuit board 10 is configured to generate high voltages (voltages) to be applied to a plurality of process units (charging rollers 2, developing devices 4, and secondary transfer roller 7) each configured to perform the image forming process. The voltages generated in the circuit board 10 are applied to the charging rollers 2, the developing devices 4, and the secondary transfer roller 7 via the power feed members 32, 34, and 37, respectively.

(Circuit Board)

Figure 2:
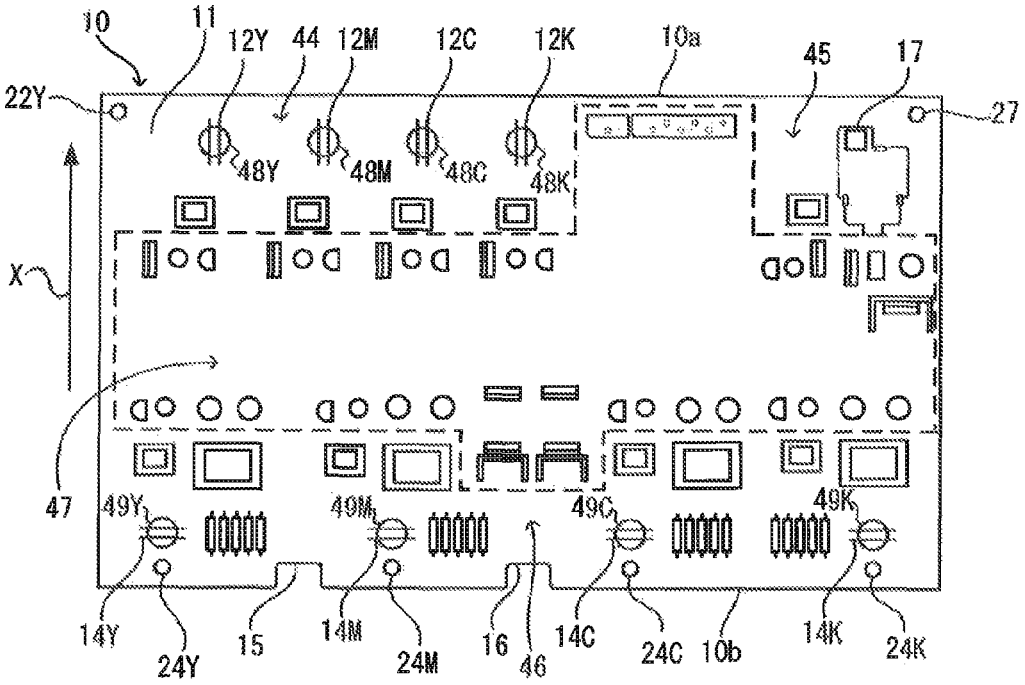
FIG. 2 is a plan view of a component side of a circuit board.

FIG. 2 is a plan view of a component side 11 of the circuit board 10. In FIG. 2, a vertical direction in a state in which the circuit board 10 is mounted on the image forming apparatus is indicated by the arrow X. Various electrical components and electronic components are mounted on the component side (component surface) 11. The circuit board 10 includes a plurality of high-voltage contact portions (output portions) configured to output high voltages. The circuit board 10 includes high-voltage contact portions (output portions) 12 (12Y, 12M, 12C, and 12K) in a high-voltage portion 44 on an upper side (outer edge) 10*a*. The high-voltage contact portions 12 are each formed of two jumper wires and are configured to output high voltages to be applied to the charging rollers 2.

The circuit board 10 includes a high-voltage contact portion (output portion) 17 in a high-voltage portion 45 in the vicinity of the upper side 10*a*. The high-voltage contact portion 17 is an output portion of a fly back transformer and is configured to output a high voltage to be applied to the secondary transfer roller 7. The circuit board 10 includes high-voltage contact portions (output portions) 14 (14Y, 14M, 14C, and 14K) in a high-voltage portion 46 on a lower side (outer edge) 10*b*. The high-voltage contact portions 14 are each formed of two jumper wires and are configured to output high voltages to be applied to the developing devices 4. Further, low-voltage components configured to generate and control a high voltage are arranged in a center portion 47 of the circuit board 10.

Each of holes 48 (48Y, 48M, 48C, and 48K) and 49 (49Y, 49M, 49C, and 49K) is formed immediately below the two jumper wires of each of the high-voltage contact portions 12 and 14. The states of springs (elastic members) 32*b* (32Yb, 32Mb, 32Cb, and 32Kb) and 34*b* (34Yb, 34Mb, 34Cb, and 34Kb) of the power feed members 32 and 34 to be described later can be visually confirmed through the holes 48 and 49, respectively. The circuit board 10 has boss holes (positioning holes) 22Y, 24Y, 24M, 24C, 24K, and 27 configured to position the power feed members 32Y, 34Y, 34M, 34C, 34K, and 37 in mounting the circuit board 10 on the power feed members 32Y, 34Y, 34M, 34C, 34K, and 37.

(Power Feed Member)

Figure 3:
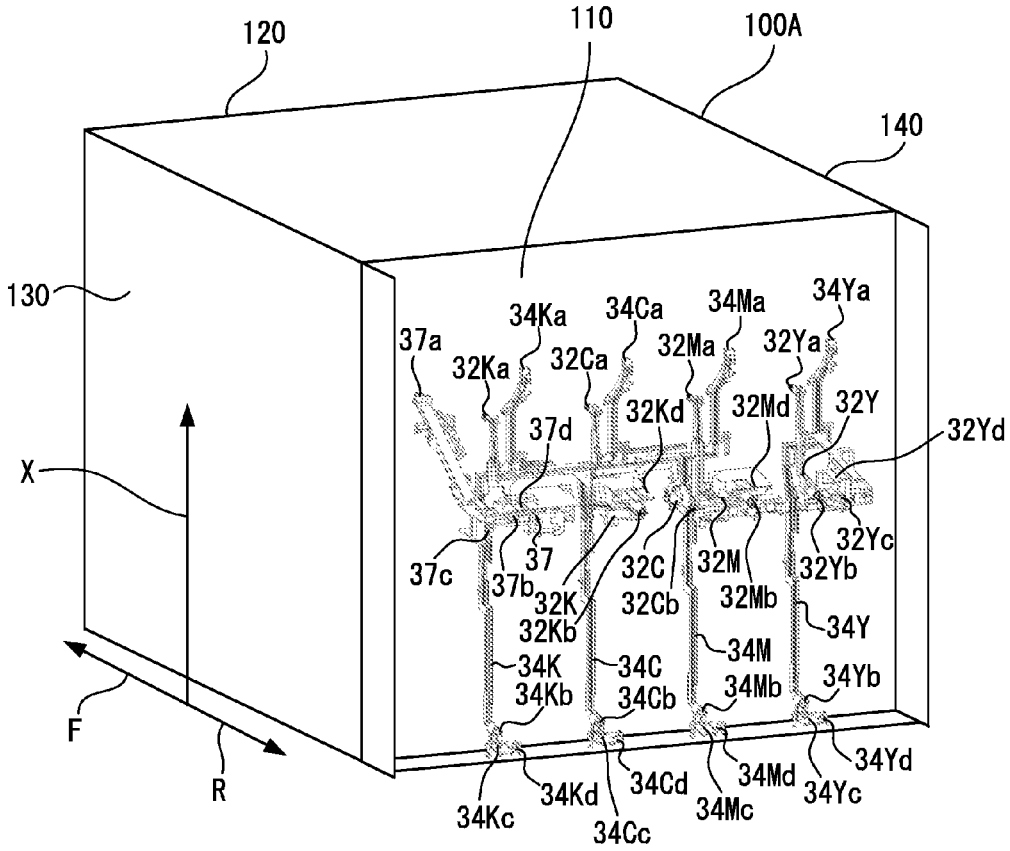
FIG. 3 is an explanatory view of power feed members mounted on a main body of the image forming apparatus.

FIG. 3 is an explanatory view for illustrating the power feed members 32 (32Y, 32M, 32C, and 32K), 34 (34Y, 34M, 34C, and 34K), and 37 mounted on the main body 100A of the image forming apparatus 100. FIG. 3 is a rear view of the main body 100A of the image forming apparatus 100. In FIG. 3, the vertical direction is indicated by the arrow X, a direction from the rear side toward the front side of the main body 100A is indicated by the arrow F, and a direction from the front side toward the rear side of the main body 100A is indicated by the arrow R. A frame of the main body 100A is formed of a front plate 120 arranged on a front side of the main body 100A, a right plate 130 arranged on a right side of the main body 100A in a front view, a left plate 140 arranged on a left side of the main body 100A in the front view, and a rear plate 110 arranged on a rear side of the main body 100A. The power feed members 32 (32Y, 32M, 32C, and 32K), 34 (34Y, 34M, 34C, and 34K), and 37 are mounted on the rear plate 110 separately from one another, and all of the power feed members 32, 34, and 37 hold the circuit board 10. The circuit board 10 is mounted on the power feed members 32, 34, and 37 in a state in which the component side 11 is opposed to the power feed members 32, 34, and 37. In other words, when the circuit board 10 is viewed from behind the main body 100A with the circuit board 10 mounted on the power feed members 32, 34, and 37, a solder side 18 on the opposite side to the component side 11 can be visually confirmed. The power feed members 34Y, 34M, 34C, and 34K are movable in a horizontal direction by approximately several millimeters even after mounting on the rear plate 110.

Next, the structure of the power feed members 32 (32Y, 32M, 32C, and 32K), 34 (34Y, 34M, 34C, and 34K), and 37 configured to hold the circuit board 10 will be described. The power feed members 32 (32Y, 32M, 32C, and 32K), 34 (34Y, 34M, 34C, and 34K), and 37 have substantially the same structure, and hence the power feed member 34Y will be described below and description of the other power feed members is omitted.

Figure 4A:
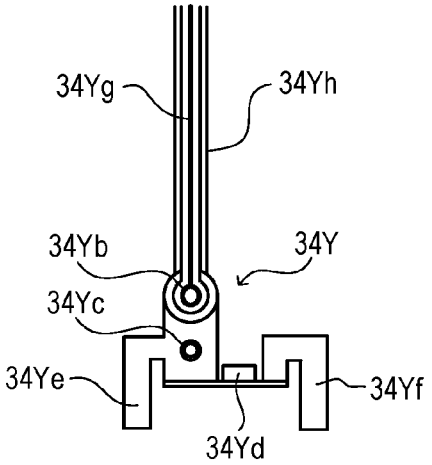
FIG. 4A, FIG. 4B, FIG. 4C, and FIG. 4D are explanatory views of one of the power feed members.
Figure 4B:
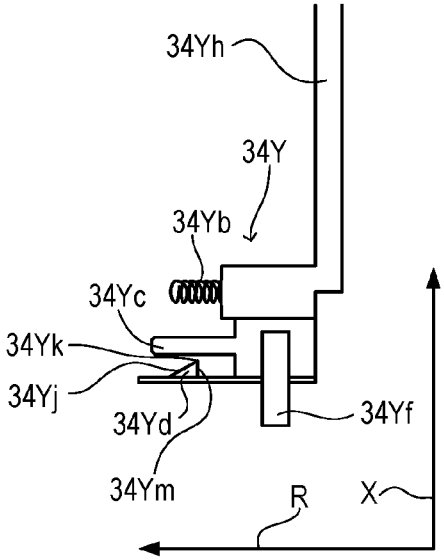
Figure 4C:
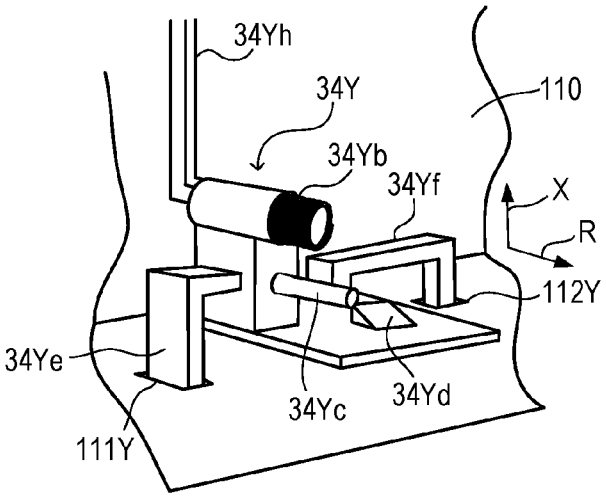
Figure 4D:
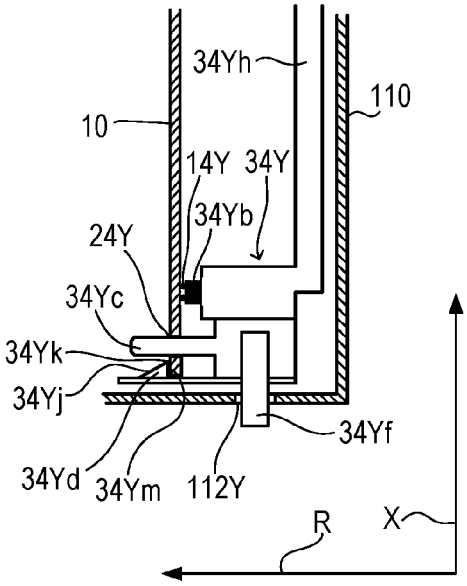

FIG. 4A, FIG. 4B, FIG. 4C, and FIG. 4D are explanatory views of the power feed member 34Y. FIG. 4A is a front view of the power feed member 34Y. FIG. 4B is a side view of the power feed member 34Y. FIG. 4C is a perspective view of the power feed member 34Y mounted on the rear plate 110. FIG. 4D is a side view of the power feed member 34Y holding the circuit board 10.

The power feed member 34Y includes a wire rod (conductor) 34Yg, the spring (conducting elastic member) 34Yb, and a mold member (holding member) 34Yh configured to hold the spring 34Yb. The power feed member 34Y is configured to hold the circuit board 10 by the mold member 34Yh. The wire rod 34Yg extends inside the power feed member 34Y, and is connected to an electrical contact of the developing device 4Y at an electrical contact 34Ya provided at one end portion of the power feed member 34Y. The spring 34Yb is a conducting elastic member having a coil shape. The spring 34Yb is electrically connected to the high-voltage contact portion 14Y of the circuit board 10. The spring 34Yb is configured to be compressed while exerting a repulsive force by being pressed toward the high-voltage contact portion 14Y of the circuit board 10 in contact with the high-voltage contact portion 14Y. The spring 34Yb is provided as a separate member from the wire rod 34Yg, but may be integrally formed with the wire rod 34Yg at one end portion of the wire rod 34Yg.

The mold member 34Yh has a boss (protruding portion) 34Yc, a holding claw (latching portion) 34Yd, and power feed member-fixing portions 34Ye and 34Yf. The boss 34Yc is a positioning portion configured to position the high-voltage contact portion 14Y of the circuit board 10 and the spring 34Yb of the power feed member 34Y. The boss 34Yc protrudes from the mold member 34Yh in a direction toward the circuit board 10. When the circuit board 10 is to be mounted on the power feed member 34Y, the boss 34Yc of the power feed member 34Y is fitted into the boss hole 24Y of the circuit board 10. The power feed members 34Y, 34M, 34C, and 34K are separate members and can be therefore positioned separately from one another. The power feed member-fixing portions 34Ye and 34Yf are respectively inserted into holes (mounting holes) 111Y and 112Y formed in the rear plate 110 to fix the position of the power feed member 34Y. When the circuit board 10 is held by the power feed member 34Y, the holding claw 34Yd is arranged at a different position from that of the boss 34Yc in the direction along the lower side (outer edge) 10*b* of the circuit board 10. When the circuit board 10 is mounted on the power feed member 34Y, the boss 34Yc is arranged between the spring 34Yb and a portion of the lower side 10*b* of the circuit board 10 which is closest to the spring 34Yb.

The holding claw 34Yd has an inclined portion 34Yj protruding in the direction R from the front side toward the rear side of the main body 100A of the image forming apparatus 100 and being inclined downward in the direction R. When the circuit board 10 is to be mounted on the power feed member 34Y, the circuit board 10 is pushed toward a side that is closer to the power feed member 34Y than a portion 34Yk of the holding claw 34Yd which has the maximum height in the vertical direction X. The mold member 34Yb which is elastically deformable bends downward to cause the circuit board 10 to move beyond the holding claw 34Yd. The circuit board 10 is pressed by the repulsive force of the spring 34Yb toward a circuit board contact portion (holding surface) 34Ym of the holding claw 34Yd and is fixed by the spring 34Yb and the holding claw 34Yd. As illustrated in FIG. 4B, when the circuit board 10 is not held by the power feed member 34Y, in the protruding direction R in which the boss 34Yc protrudes, the boss 34Yc extends beyond the spring 34Yb, and the spring 34Yb extends beyond the circuit board contact portion 34Ym of the holding claw 34Yd.

As described above, it is necessary to press the vicinities of the high-voltage contact portions 12, 14, and 17 of the circuit board 10 with a force of a predetermined value in order to correctly mount the circuit board 10 on the power feed members 32 (32Y, 32M, 32C, and 32K), 34 (34Y, 34M, 34C, and 34K), and 37. Contrary to this, when the vicinities of the high-voltage contact portions 12, 14, and 17 of the circuit board 10 are not pressed or the pressing force is not sufficient, the circuit board 10 is not correctly mounted on the power feed members 32, 34, and 37. Therefore, electrical conduction failure occurs between the high-voltage contact portions 12, 14, and 17 and the springs 32Yb, 32Mb, 32Cb, 32Kb, 34Yb, 34Mb, 34Cb, 34Kb, and 37*b*.

(Silk-Printed Mark)

Figure 5:
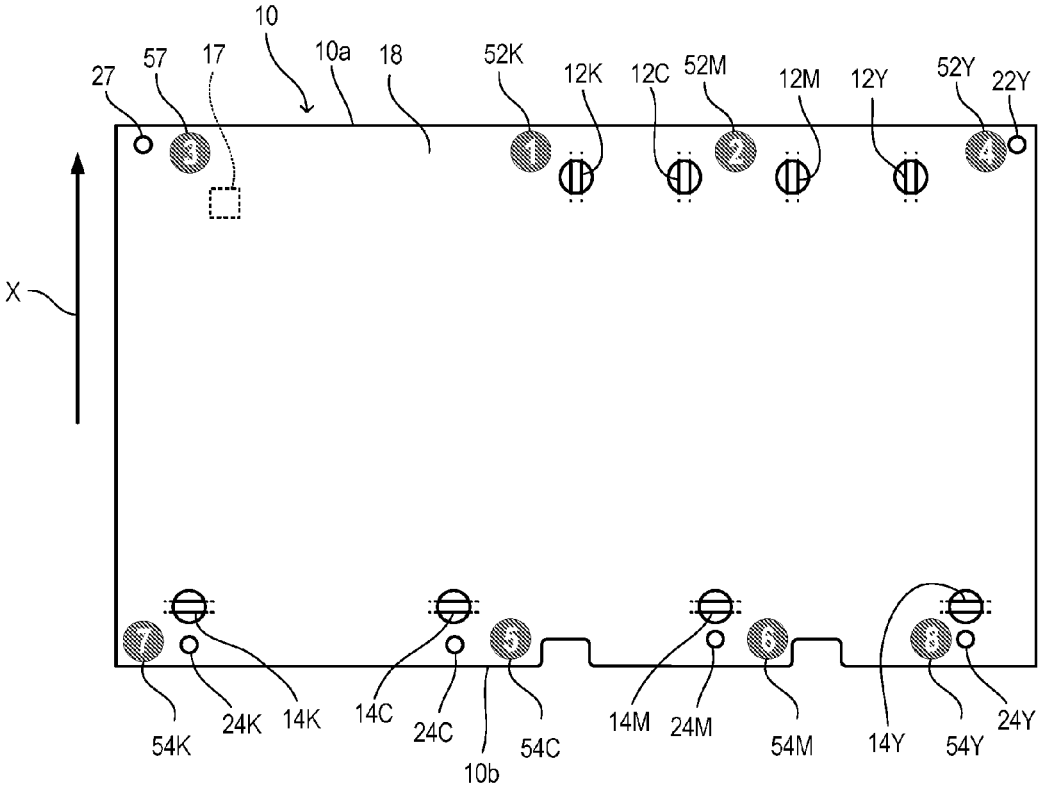
FIG. 5 is a plan view of a solder side of a circuit board according to a first embodiment.

In view of the above, in the embodiment, silk-printed marks are put on the solder side 18 of the circuit board 10 at portions to be pressed by an operator so that the operator reliably presses the portions in the vicinities of the high-voltage contact portions 12, 14, and 17 of the circuit board 10. There are provided a plurality of silk-printed marks on the circuit board 10. FIG. 5 is a plan view of the solder side 18 of the circuit board 10 according to the first embodiment. Various surface-mounted components (not shown) and lead wires of inserted components (not shown) are arranged on the solder side 18 of the circuit board 10 and signs (not shown) of the respective components are placed by silk printing. Silk printing can be performed at the time of printing of conductor patterns (circuit wiring) of the circuit board 10. Therefore, a printing step can be omitted as compared to printing using other methods. As compared to marking using stickers, a sticker affixing step can be omitted by putting the silk-printed marks on the circuit board 10.

Silk-printed marks 52Y, 52M, 52K, 54Y, 54M, 54C, 54K, and 57 are put on the solder side 18 of the circuit board 10. The silk-printed marks 52Y, 52M, 52K, 54Y, 54M, 54C, 54K, and 57 are marks which prompt the operator to press the circuit board 10 correctly when the operator causes the circuit board 10 to be held by the holding claws of the power feed members 32, 34, and 37. The silk-printed marks 52Y, 52M, 52K, 54Y, 54M, 54C, 54K, and 57 indicate outline numerals on solid circular marks. The silk-printed marks 52Y, 52M, 52K, 54Y, 54M, 54C, 54K, and 57 are arranged in the vicinities of the high-voltage contact portions 12Y, 12M, 12K, 14Y, 14M, 14C, 14K, and 17 of the circuit board 10, respectively. The silk-printed marks 52Y, 52M, 52K, 54Y, 54M, 54C, 54K, and 57 are marks which indicate portions to be pressed by the operator when the circuit board 10 is to be mounted on the power feed members 32, 34, and 37. The silk-printed marks 52Y, 52M, 52K, 54Y, 54M, 54C, 54K, and 57 are prominent marks each having approximately the size of a fingertip of the operator so that the operator can easily recognize portions to press. Outline numerals 1, 2, 3, 4, 5, 6, 7, and 8 are indicated on the silk-printed marks 52K, 52M, 57, 52Y, 54C, 54M, 54K, and 54Y, respectively. The numerals indicate the order in which the operator is to press the circuit board 10.

In the embodiment, first of all, the operator presses the silk-printed marks 52K and 52M in the vicinity of the center of the upper side 10*a* of the circuit board 10 to fix the circuit board 10 to the power feed members 32K, 32C, and 32M. Then, the operator presses the silk-printed marks 57 and 52Y in the vicinities of both end portions of the upper side 10*a* of the circuit board 10 to fix the circuit board 10 to the power feed members 37 and 32Y. Further, the operator presses the silk-printed marks 54C and 54M in the vicinity of the center of the lower side 10*b* of the circuit board 10 to fix the circuit board 10 to the power feed members 34C and 34M. Finally, the operator presses the silk-printed marks 54K and 54Y in the vicinities of both the end portions of the lower side 10*b* of the circuit board 10 to fix the circuit board 10 to the power feed members 34K and 34Y.

Moreover, the silk-printed marks 52Y, 52M, 52K, 54Y, 54M, 54C, 54K, and 57 are desirably arranged at portions of the circuit board 10 on which conductor patterns are not provided so that the operator does not cause damage to the conductor patterns (circuit wiring) of the circuit board 10 by mistake during the mounting operation. Moreover, the silk-printed marks 52Y, 52M, 52K, 54Y, 54M, 54C, 54K, and 57 are desirably arranged at portions of the circuit board 10 on which lead portions of component parts are not provided. In the embodiment, the silk-printed marks 52Y, 52M, 52K, 54Y, 54M, 54C, 54K, and 57 are circular. However, the silk-printed marks are not necessarily circular but may have other shapes such as an elliptical shape, a semicylindrical shape, and a quadrilateral shape.

According to the embodiment, the silk-printed solid marks 52Y, 52M, 52K, 54Y, 54M, 54C, 54K, and 57 are put on the solder side 18 of the circuit board 10. The silk-printed marks 52Y, 52M, 52K, 54Y, 54M, 54C, 54K, and 57 indicate portions to be pressed by the operator when the circuit board 10 is to be mounted on the power feed members 32 (32Y, 32M, 32C, and 32K), 34 (34Y, 34M, 34C, and 34K), and 37. Therefore, mounting failure of the circuit board 10 on the power feed members 32 (32Y, 32M, 32C, and 32K), 34 (34Y, 34M, 34C, and 34K), and 37 can be prevented from occurring.

According to the embodiment, in the configuration in which the circuit board 10 is held by the holding claws of the power feed members 32, 34, and 37 when pressed by a force of a predetermined value or more, the silk-printed marks which prompt the operator to correctly press the portions to press on the circuit board 10 are put on the circuit board 10. Therefore, mounting failure of the circuit board 10 can be prevented from occurring due to forgetting to press the circuit board 10 or an insufficient pressing force.

According to the embodiment, the circuit board can be mounted on the image forming apparatus with improved workability. According to the embodiment, the portions at which the circuit board is correctly pressed can be easily pressed when the circuit board is to be held by the holding claws. Thus, the circuit board can be mounted with improved workability.

[Second Embodiment]

A second embodiment of the present invention will be described below. In the second embodiment, the same structures as those of the first embodiment are denoted by the same reference symbols and their description is omitted. An image forming apparatus, a component side of a circuit board, and power feed members in the second embodiment are the same as the image forming apparatus 100, the component side 11 of the circuit board 10, and the power feed members 32, 34, and 37 in the first embodiment, respectively, and hence their description is omitted. In the first embodiment, the silk-printed solid marks are put on the solder side 18 of the circuit board 10 at the portions to be pressed by the operator at the time of mounting the circuit board 10 on the power feed members 32, 34, and 37, thereby preventing occurrence of mounting failure of the circuit board 10. In contrast, according to the second embodiment, marks (signs) which allow the operator to notice that the circuit board 10 is not correctly mounted on the power feed members 32, 34, and 37 are put on the solder side 18 of the circuit board 10 by silk printing, thereby preventing occurrence of mounting failure of the circuit board 10.

(Silk-Printed Mark)

Figure 6:
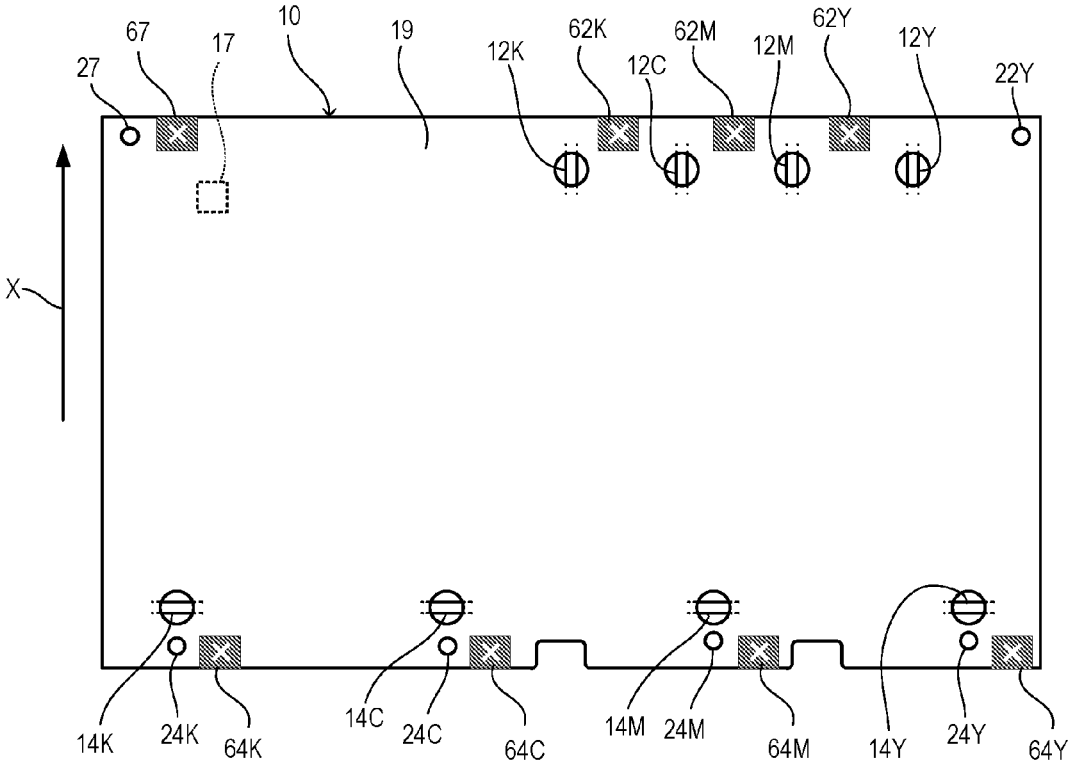
FIG. 6 is a plan view of a solder side of a circuit board according to a second embodiment.

FIG. 6 is a plan view of a solder side 19 of the circuit board 10 according to the second embodiment. Silk-printed marks 62Y, 62M, 62K, 64Y, 64M, 64C, 64K, and 67 are put on the solder side 19 of the circuit board 10. The silk-printed marks 62Y, 62M, 62K, 64Y, 64M, 64C, 64K, and 67 have outline letters (symbols) X on solid rectangular marks, respectively. The silk-printed marks 62Y, 62M, 62K, 64Y, 64M, 64C, 64K, and 67 have substantially the same sizes as respective circuit board contact portions of holding claws (32Yd, 32Md, 32Kd, 34Yd, 34Md, 34Cd, 34Kd, and 37*d*) of the power feed members 32, 34, and 37. The circuit board contact portion 34Ym of the holding claw 34Yd is only illustrated in FIG. 4B and FIG. 4D, and the other circuit board contact portions are not illustrated.

Figure 7A:
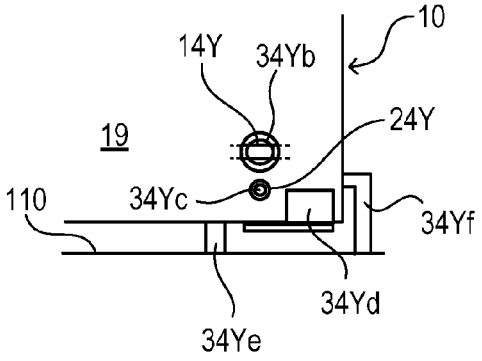
FIG. 7A and FIG. 7B are explanatory views for illustrating mounting of the circuit board according to the second embodiment.
Figure 7B:
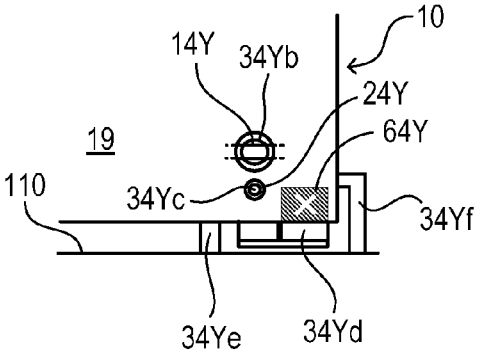

FIG. 7A and FIG. 7B are explanatory views for illustrating mounting of the circuit board 10 according to the second embodiment. FIG. 7A and FIG. 7B are illustrations of exemplary mounting of the circuit board 10 on the power feed member 34Y. Mounting of the circuit board 10 on the other power feed members 34M, 34C, 34K, 32Y, 32M, 32C, 32K, and 37 is substantially the same as that of the circuit board 10 on the power feed member 34Y, and hence its description is omitted. FIG. 7A is an illustration of a state in which the circuit board 10 is correctly mounted on the power feed member 34Y. FIG. 7B is an illustration of a state in which the circuit board 10 is not correctly mounted on the power feed member 34Y.

When the circuit board 10 is to be mounted on the power feed member 34Y, the circuit board 10 moves up on the inclined portion 34Yj of the holding claw 34Yd. When the pressing force in mounting the circuit board 10 is equal to or larger than a predetermined value, the circuit board 10 moves beyond the maximum height portion 34Yk of the holding claw 34Yd and fixed with the spring 34Yb and the holding claw 34Yd so as to enter the state as illustrated in FIG. 7A. In the state, the holding claw 34Yd and the silk-printed mark 64Y of the circuit board 10 overlap each other and therefore the operator cannot visually confirm the silk-printed mark 64Y. The operator confirms that the silk-printed mark 64Y is hidden on the back side of the holding claw 34Yd, so that the operator can easily confirm that the circuit board 10 is correctly fixed to the power feed member 34Y.

On the other hand, when the pressing force in mounting the circuit board 10 is smaller than the predetermined value, the circuit board 10 cannot move beyond the maximum height portion 34Yk of the holding claw 34Yd. The circuit board 10 may remain on the inclined portion 34Yj of the holding claw 34Yd. The circuit board 10 cannot be correctly positioned between the spring 34Yb and the circuit board contact portion 34Ym of the holding claw 34Yd. Accordingly, the circuit board 10 is not fixed to the power feed member 34, thus causing electrical conduction failure between the spring 34Yb and the high-voltage contact portion 14Y. When the circuit board 10 is not correctly fixed to the power feed member 34Y, the circuit board 10 enters the state as illustrated in FIG. 7B. The operator can visually confirm the silk-printed mark 64Y of the circuit board 10 and therefore easily confirm that the mounting of the circuit board 10 is in an abnormal state. In this case, the operator can notice abnormal mounting of the circuit board 10 at once and press the circuit board 10 again to fix the circuit board 10 to the power feed member 34 without fail, which can ensure the connection between the spring 34Yb and the high-voltage contact portion 14Y.

In the embodiment, the silk-printed marks 62Y, 62M, 62K, 64Y, 64M, 64C, 64K, and 67 have outline letters (symbols) X, respectively, but may have outline numerals indicating the order in which the operator is to press the circuit board 10. Moreover, the silk-printed marks 62Y, 62M, 62K, 64Y, 64M, 64C, 64K, and 67 may be put on portions of the circuit board 10 on which any conductor patterns are not provided. In addition, the silk-printed marks 62Y, 62M, 62K, 64Y, 64M, 64C, 64K, and 67 may be put on portions of the circuit board 10 on which any lead portions of components are not provided. In the embodiment, the silk-printed marks 62Y, 62M, 62K, 64Y, 64M, 64C, 64K, and 67 are rectangular. However, the silk-printed marks are not necessarily rectangular but may have other shapes such as an elliptical shape, a semicylindrical shape, and a circular shape. The silk-printed marks only need to have such a shape that the operator does not see the silk-printed marks when the circuit board 10 is correctly mounted on the power feed members 32, 34, and 37 and easily notices when the circuit board 10 is not correctly mounted on the power feed members 32, 34, and 37.

According to the embodiment, marks (signs) which allow the operator to easily notice when the circuit board 10 is not correctly mounted on the power feed members 32, 34, and 37 are put on the solder side 19 of the circuit board 10 by silk printing, thereby being capable of preventing occurrence of mounting failure of the circuit board 10.

According to the embodiment, in the configuration in which the circuit board 10 is held by the holding claws of the power feed members 32, 34, and 37 when pressed by a force of a predetermined value or more, the silk-printed marks which allow the operator to easily notice abnormal mounting of the circuit board 10 are put on the circuit board 10. Therefore, mounting failure of the circuit board 10 can be prevented from occurring due to forgetting to press the circuit board 10 or an insufficient pressing force.

According to the embodiment, the circuit board can be mounted on the image forming apparatus with improved workability. According to the embodiment, the operator can easily notice that the circuit board is not correctly held by the holding claws when the silk-printed marks can be visually recognized. Thus, the circuit board can be mounted with improved workability.

The configuration in which the circuit board 10 is held by the holding claws of the power feed members 32, 34, and 37 is described in the embodiment. However, the circuit board 10 may be held by holding claws provided on the main body 100A of the image forming apparatus 100. In this case, in a configuration in which the circuit board 10 is held by the holding claws of the main body 100A when pressed by a force of a predetermined value or more, silk-printed marks which prompt the operator to correctly press portions to press on the circuit board 10 may be put on the circuit board 10. Alternatively, silk-printed marks which allow the operator to easily notice abnormal mounting of the circuit board 10 may be put on the circuit board 10. The silk-printed marks are put on not only portions in the vicinities of the high-voltage contact portions 12, 14, and 17 but also portions in the vicinities of a portion for mounting on the main body 100A. The silk-printed marks may be put on end portions of the circuit board 10.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-003955, filed Jan. 13, 2015, which is hereby incorporated by reference herein in its entirety.

What is claimed is:

1. An image forming apparatus configured to form an image on a recording medium, the image forming apparatus comprising:

a process unit to which a high voltage is applied, and the process unit being configured to perform an image forming process;

a circuit board configured to generate the high voltage to be applied to the process unit;

a holding claw configured to hold the circuit board;

a power feed member configured to apply the high voltage to the process unit, the power feed member having an elastic member electrically connected to an output portion of the circuit board from which the high voltage is output in a state in which the circuit board is held by the holding claw; and a silk-printed mark put on the circuit board, the silk-printed mark indicating a portion of the circuit board to be pressed by an operator in order to cause the circuit board to be held by the holding claw, wherein the output portion of the circuit board comprises a plurality of output portions, the silk-printed mark comprises a plurality of silk-printed marks, the plurality of silk-printed marks comprise outline numerals on solid marks, and the outline numerals indicate an order in which the operator is to press the circuit board.

2. An image forming apparatus configured to form an image on a recording medium, the image forming apparatus comprising:

a process unit to which a high voltage is applied, and the process unit being configured to perform an image forming process;

a circuit board configured to generate the high voltage to be applied to the process unit;

a holding claw configured to hold the circuit board;

a power feed member configured to apply the high voltage to the process unit, the power feed member having an elastic member electrically connected to an output portion of the circuit board from which the high voltage is output in a state in which the circuit board is held by the holding claw; and a silk-printed mark put on the circuit board, the silk-printed mark indicating a portion of the circuit board to be pressed by an operator in order to cause the circuit board to be held by the holding claw, wherein the process unit comprises a plurality of process units, the power feed member comprises a plurality of separate power feed members configured to hold the circuit board, the output portion comprises a plurality of output portions arranged at different positions in a direction along an outer edge of the circuit board, which are configured to output the high voltages to be applied to the plurality of process units, respectively, the circuit board has a plurality of positioning holes configured to position the plurality of separate power feed members, respectively, and each of the plurality of separate power feed members comprises a positioning portion to be fitted into a corresponding positioning hole of the plurality of positioning holes of the circuit board, the positioning portion being arranged at a position closer to the outer edge of the circuit board than the elastic member; and the holding claw arranged at a different position from a position of the positioning portion in the direction along the outer edge.

3. An image forming apparatus according to claim 2, wherein the silk-printed mark has approximately a size of a fingertip of the operator.

4. An image forming apparatus according to claim 2, wherein the silk-printed mark is put on a portion of the circuit board on which neither a conductor pattern nor a lead portion of a component part of the circuit board is provided.

5. An image forming apparatus according to claim 2, wherein the plurality of separate power feed members are mounted on a main body of the image forming apparatus so as to be movable with respect to the main body.

6. An image forming apparatus according to claim 2, wherein the positioning portion is arranged between the elastic member and a portion of the outer edge which is closest to the elastic member.

7. An image forming apparatus according to claim 2, wherein the elastic member has conductivity, the positioning portion comprises a protruding portion, and when the circuit board is not held by the plurality of separate power feed members, in a protruding direction in which the protruding portion protrudes, the protruding portion extends beyond the elastic member, and the elastic member extends beyond a holding surface on which the holding claw holds the circuit board.

8. An image forming apparatus according to claim 2, further comprising:

a plurality of photosensitive members; and a plurality of charging devices to which voltages are applied to charge the plurality of photosensitive members, respectively, wherein the plurality of process units comprise a plurality of developing devices configured to develop electrostatic latent images formed on the plurality of photosensitive members, respectively, the circuit board further comprises a plurality of output portions configured to output the voltages to be applied to the plurality of charging devices, respectively, the outer edge comprises a lower side of the circuit board, the plurality of output portions configured to output the voltages to be applied to the plurality of process units, respectively, are arranged in a vicinity of the lower side, and the plurality of output portions configured to output the voltages to be applied to the plurality of charging devices, respectively, are arranged in a vicinity of an upper side of the circuit board at different positions in a direction along the upper side.

9. An image forming apparatus according to claim 2, wherein the each of the plurality of separate power feed members comprises a fixing portion to be inserted into a mounting hole formed in the image forming apparatus.

10. An image forming apparatus configured to form an image on a recording medium, the image forming apparatus comprising:

a process unit to which a high voltage is applied, and the process unit being configured to perform an image forming process;

a circuit board configured to generate the high voltage to be applied to the process unit;

a holding claw configured to hold the circuit board;

a power feed member configured to apply the high voltage to the process unit, the power feed member having an elastic member electrically connected to an output portion of the circuit board from which the high voltage is output in a state in which the circuit board is held by the holding claw; and a silk-printed mark put on the circuit board, the silk-printed mark being in sight when the circuit board is not correctly held by the holding claw, and being out of sight when the circuit board is correctly held by the holding claw, wherein the output portion of the circuit board comprises a plurality of output portions, the silk-printed mark comprises a plurality of silk-printed marks, the plurality of silk-printed marks comprise outline numerals on solid marks, and the outline numerals indicate an order in which the operator is to press the circuit board.

11. An image forming apparatus configured to form an image on a recording medium, the image forming apparatus comprising:

a process unit to which a high voltage is applied, and the process unit being configured to perform an image forming process;

a circuit board configured to generate the high voltage to be applied to the process unit;

a holding claw configured to hold the circuit board;

a power feed member configured to apply the high voltage to the process unit, the power feed member having an elastic member electrically connected to an output portion of the circuit board from which the high voltage is output in a state in which the circuit board is held by the holding claw; and a silk-printed mark put on the circuit board, the silk-printed mark being in sight when the circuit board is not correctly held by the holding claw, and being out of sight when the circuit board is correctly held by the holding claw, wherein the process unit comprises a plurality of process units, the power feed member comprises a plurality of separate power feed members configured to hold the circuit board, the output portion comprises a plurality of output portions arranged at different positions in a direction along an outer edge of the circuit board, which are configured to output the high voltages to be applied to the plurality of process units, respectively, the circuit board has a plurality of positioning holes configured to position the plurality of separate power feed members, respectively, and each of the plurality of separate power feed members comprises a positioning portion to be fitted into a corresponding positioning hole of the plurality of positioning holes of the circuit board, the positioning portion being arranged at a position closer to the outer edge of the circuit board than the elastic member; and the holding claw arranged at a different position from a position of the positioning portion in the direction along the outer edge.

12. An image forming apparatus according to claim 11, wherein the silk-printed mark has substantially the same size as a contact portion of the holding claw which is brought into contact with the circuit board.

13. An image forming apparatus according to claim 11, wherein the silk-printed mark is put on a portion of the circuit board on which neither a conductor pattern nor a lead portion of a component part is provided.

14. An image forming apparatus according to claim 11, wherein the plurality of separate power feed members are mounted on a main body of the image forming apparatus so as to be movable with respect to the main body.

15. An image forming apparatus according to claim 11, wherein the positioning portion is arranged between the elastic member and a portion of the outer edge which is closest to the elastic member.

16. An image forming apparatus according to claim 11, wherein the elastic member has conductivity, the positioning portion comprises a protruding portion, and when the circuit board is not held by the plurality of separate power feed members, in a protruding direction in which the protruding portion protrudes, the protruding portion extends beyond the elastic member, and the elastic member extends beyond a holding surface on which the holding claw holds the circuit board.

17. An image forming apparatus according to claim 11, further comprising:

a plurality of photosensitive members; and a plurality of charging devices to which voltages are applied to charge the plurality of photosensitive members, respectively, wherein the plurality of process units comprise a plurality of developing devices configured to develop electrostatic latent images formed on the plurality of photosensitive members, respectively, the circuit board further comprises a plurality of output portions configured to output the voltages to be applied to the plurality of charging devices, respectively, the outer edge comprises a lower side of the circuit board, the plurality of output portions configured to output the voltages to be applied to the plurality of process units, respectively, are arranged in a vicinity of the lower side, and the plurality of output portions configured to output the voltages to be applied to the plurality of charging devices, respectively, are arranged in a vicinity of an upper side of the circuit board at different positions in a direction along the upper side.

18. An image forming apparatus according to claim 11, wherein the each of the plurality of separate power feed members comprises a fixing portion to be inserted into a mounting hole formed in the image forming apparatus.

* * * * *